US010946349B2

(12) United States Patent
Linne et al.

(10) Patent No.: US 10,946,349 B2
(45) Date of Patent: Mar. 16, 2021

(54) MIXING ELEMENT FOR A STATIC MIXER

(71) Applicant: Sulzer Mixpac AG, Haag (CH)

(72) Inventors: Volker Linne, Rosenthal (DE); Sasan Habibi-Naini, Rikon (CH)

(73) Assignee: SULZER MIXPAC AG, Haag (CH)

( * ) Notice: Subject to any disclaimer, the term of this patent is extended or adjusted under 35 U.S.C. 154(b) by 359 days.

(21) Appl. No.: 15/674,962

(22) Filed: Aug. 11, 2017

(65) Prior Publication Data

US 2017/0341041 A1 Nov. 30, 2017

Related U.S. Application Data

(63) Continuation of application No. 13/554,650, filed on Jul. 20, 2012, now Pat. No. 9,764,296.

(30) Foreign Application Priority Data

Jul. 22, 2011 (EP) ..... 11175070

(51) Int. Cl.
*B01F 5/06* (2006.01)

(52) U.S. Cl.
CPC .... *B01F 5/0641* (2013.01); *B01F 2215/0039* (2013.01)

(58) Field of Classification Search
CPC ..... B01F 5/0641; B01F 2215/0039
USPC ..... 366/337
See application file for complete search history.

(56) References Cited

U.S. PATENT DOCUMENTS 5,851,067 A 12/1998 Fleischli et al.
5,944,419 A 8/1999 Streiff
6,530,685 B1 * 3/2003 Muhlbauer ..... A61C 9/0026 222/145.6
7,325,970 B2 2/2008 Keller
7,841,765 B2 11/2010 Keller
2003/0179647 A1 9/2003 Heusser et al.
2004/0141413 A1 7/2004 Keller
2006/0187752 A1 8/2006 Keller
2006/0245299 A1 11/2006 Heusser et al.
(Continued)

FOREIGN PATENT DOCUMENTS

EP 0749776 A1 12/1996
EP 0815929 A1 1/1998
(Continued)

OTHER PUBLICATIONS

European search report for corresponding EP 11175070.9-2307 dated Jan. 23, 2012.

*Primary Examiner* — Marc C Howell

(74) *Attorney, Agent, or Firm* — Global IP Counselors, LLP

(57) ABSTRACT

A mixing element for a static mixer for installation into a tubular mixer housing has a longitudinal axis along which a plurality of installation bodies are arranged behind one another. A first installation body has a first wall element which extends in the direction of the longitudinal axis and a first side wall and a second side wall which is arranged opposite the first side wall. A deflection element is arranged adjacent to the first wall element and has a deflection surface extending in the transverse direction to the wall element at both sides of the wall element. A first opening is provided in the deflection surface at the side which faces the first side wall of the first wall element.

16 Claims, 4 Drawing Sheets

(56) References Cited

U.S. PATENT DOCUMENTS

| | | | | |
|---|---|---|---|---|
| 2008/0232191 | A1* | 9/2008 | Keller | B01F 5/0617 366/339 |
| 2010/0097883 | A1 | 4/2010 | Habibi-Naini | |
| 2012/0134232 | A1* | 5/2012 | Schneider | B01F 5/0619 366/336 |

FOREIGN PATENT DOCUMENTS

| | | | |
|---|---|---|---|
| EP | 1312409 | A1 | 5/2003 |
| EP | 1426099 | A1 | 6/2004 |
| EP | 2181827 | A2 | 5/2010 |
| JP | H09-000901 | A | 1/1997 |
| JP | H11-042426 | A | 2/1999 |
| JP | 2003-275556 | A | 9/2003 |
| WO | 2004052519 | A1 | 6/2004 |
| WO | 2007110316 | A1 | 10/2007 |

* cited by examiner

MIXING ELEMENT FOR A STATIC MIXER

PRIORITY CLAIM

The present application is a continuation application of U.S. patent application Ser. No. 13/554,650, filed on Jul. 20, 2012, which claims priority to European Patent Application No. 11175070.9, filed on Jul. 22, 2011, the contents of each of which are incorporated herein by reference.

BACKGROUND

The invention relates to a static mixer of plastic including an installation body for installation into a tubular mixer housing. This installation body has a longitudinal axis which is aligned in the direction of a fluid flowing into the installation body so that a mixing space can be spanned by the installation body. The mixing space has a cross-sectional flow area in a plane normal to the longitudinal axis which essentially corresponds to the cross-sectional flow area of the tubular mixer housing. The installation body includes a wall element for the division and/or deflection of the fluid flow in a direction deviating from the longitudinal axis.

Such a static mixer is, for example, known from EP1426099 B1. In this static mixer, two components are mixed with one another by means of a plurality of mixing elements of the same type in a three-part mixing process in which the material is first divided, then spread and displaced. This mixing process has to be carried out several times depending on the physical properties of the components. For this reason, the static mixer contains a plurality of installation bodies of the same construction arranged behind one another. These mixers are in particular used for the mixing of small quantities of the components, that is a few milliliters to approximately 1,000 milliliters. Accordingly, these mixers have a mixing space with a diameter of less than 16 mm with a length of more than 50 mm. This has the consequence that the wall thicknesses of the wall elements of this mixer can amount to less than 1 mm, often even less than 0.5 mm.

Such a static mixer in accordance with EP1426099 B1 of plastic is preferably manufactured in an injection molding process. The manufacture of a mixer of 30 mm length with a wall thickness of less than 3 mm using the injection molding process, as shown in FIG. 1 of this patent, was previously not possible since the flowpath from the injection point of the injection molding tool up to the oppositely disposed end of the mixer would require internal tool pressures which are too high. To be able to manufacture a static mixer having such small wall thicknesses economically in the injection molding process, each installation body is connected to the adjacent installation body via bar elements. These bar elements allow the polymer melt in the injection molding tool to move from one installation body to an adjacent installation body and to maintain the internal tool pressures below 1000 bar so that a failure of the injection molding tool can be prevented such as is shown in an arrangement of two installation bodies in accordance with FIG. 4 of EP 2 181 827 A1 which corresponds in its arrangement of wall elements and deflection elements to the embodiment in accordance with FIG. 15 or FIG. 17 of EP1426099 B1. As a major difference from EP1426099 B2, the bar elements of EP 2 181 827 A1 only serve for the connection of one installation body to an adjacent installation body. In contrast, the bar elements in accordance with FIG. 15 of EP1426099 B1 can extend over a plurality of installation bodies. The bar elements take up mixing space and were therefore avoided where possible or designed in accordance with the previous teaching such that they only connect some of the installation bodies with one another; in accordance with FIG. 15 of EP1426099 B1 a maximum of 5 installation bodies. It only became possible by the method in accordance with EP 2 181 827 to provide bar elements which each only connect two adjacent installation bodies to one another. It has, however, proved to be disadvantageous in this development that the stability of the mixing element made up of the installation bodies is also affected. It has in particular been found in the dispensing of viscous materials that the mixing element can break.

SUMMARY

It is the object of the invention to provide a more stable mixing element in which simultaneously the pressure loss with respect to the aforesaid solutions is reduced with the same structure.

The object of the invention is satisfied by a mixing element whose installation bodies are connected to one another via a common bar element. The mixing element becomes stiffer, that is the resistance to break is increased, by the provision of a bar element. However, this solution has previously not been favored in the technical world since according to previous experience the provision of a bar element was said to result in increased pressure loss. This assumption was confirmed for a helical mixer in comparison with a mixing element in accordance with EP 1426099 B1. The required force for dispensing the filler material was measured for a filler material A for a helical mixer and this force amounted to 472 N in the experiment. A force of 540 N was measured for the same filler material for a mixing element in accordance with EP 1426099 B1 which is therefore higher, as was to be expected, because the installations of this mixing element take up a higher proportion of mixing space. As is to be expected, the pressure loss of the mixing element in accordance with EP 1426099 B1 is therefore higher.

If a bar element is provided which connects all installation bodies to one another, it can thus be expected that the stability of the mixing element is further increased; however, in that an even higher proportion of mixing space is taken up by the mixing element, the pressure loss also increases and thus the force for dispensing the filler material increases. The experiment, however, surprisingly delivered a force of 493 N. This value is between the value for the helical mixer and the value for the mixing element in accordance with EP 1426099 B1.

This experiment was repeated for a filler material B. For the helical mixer, the force amounted to 410 N on use of filler material B; 461 N for the mixing element in accordance with EP 1426099 B1; and 443 N for the mixing element in accordance with the invention.

Filler material A is marketed under the trade name Voco registrado X-tra; filler material B is marketed under the trade name Kettenbach Monopren.

The experiment results show that the surprising effect is achieved independently of the filler material used thus it is inherent to the structure of the mixing element.

It was also found in the experiment that the homogeneity of the mixture for a mixing element in accordance with the invention is improved with respect to the prior art with the same mixer length. The mixer can in particular have a longer length due to the lower pressure loss. The maximum force which can be applied manually to press the filler material through the mixing element is limited. It follows from this that a mixing element which has a reduced pressure loss is simpler to handle with the same construction length. Furthermore, the mixing element in accordance with the invention can be extended with respect to a mixing element from the prior art having installation bodies which have a larger pressure loss. This means that the mixing element can contain more installation bodies than, for example, the mixing element already known from EP 2 181 827 A1 so that the mixing quality can be improved.

The mixing element is provided for a static mixer for installation in a tubular mixer housing. The mixing element has a longitudinal axis along which a plurality of installation bodies are arranged behind one another, with a first installation body having a first wall element which extends in the direction of the longitudinal axis. The wall element has a first side wall and a second side wall which is arranged opposite the first side wall. A deflection element is arranged adjacent to the first wall element and has a deflection surface extending in a transverse direction to the wall element at both sides of the wall element, with a first opening being provided in the deflection surface at a side which faces the first side wall of the wall element.

A second and a third wall element are arranged adjacent to the first opening, with the second and third wall elements extending in the direction of the longitudinal axis and having a respective one inner wall and one outer wall which extend substantially in the direction of the longitudinal axis. Each of the inner walls and outer walls include an angle between 20° and 160° to the first or second side wall of the first wall element. The first opening is arranged between the inner walls of the second and third wall elements and a second opening is arranged outside one of the outer walls of the second or third wall elements, with the second opening being provided in the deflection surface at the side which faces the second side wall of the first wall element.

A second and a third wall element are thus arranged opposite the first wall element adjacent to the first opening in the direction of the longitudinal axis, with the second and third wall elements bounding a passage starting from the first opening and extending in the direction of the longitudinal axis. A second opening is provided in the deflection surface at the side which faces the second side wall of the wall element, with the second or third wall elements adjoining the second opening. Furthermore, the first wall element of the second installation body adjoins the second and third wall elements. More than five installation bodies are connected to one another via a common bar element.

The second installation body can in particular also have a first wall element which extends in the direction of the longitudinal axis and a first side wall and a second side wall which is arranged opposite the first side wall. A deflection element can be arranged adjacent to the first wall element and can have a deflection surface extending in a transverse direction to the wall element at both sides of the wall element, with a first opening being able to be provided in the deflection surface at the side which faces the first side wall of the wall element.

A second and a third wall element can in turn be arranged adjacent to the first opening, with the second and third wall elements extending in the direction of the longitudinal axis and having a respective one inner wall and one outer wall which extend substantially in the direction of the longitudinal axis. Each of the inner walls and outer walls can include an angle between 20° and 160° to the first or second side wall of the first wall element. The first opening can be arranged between the inner walls of the second and third wall elements and a second opening can be arranged outside one of the outer walls of the second or third wall elements, with the second opening being able to be provided in the deflection surface at the side which faces the second side wall of the first wall element.

This means that a second and a third wall element can be arranged opposite the first wall element adjacent to the first opening in the direction of the longitudinal axis, with the second and third wall elements being able to bound a passage starting from the first opening and extending in the direction of the longitudinal axis. A second opening can be provided in the deflection surface at the side which faces the second side wall of the wall element, with the second or third wall elements being able to adjoin the second opening, with the second installation body composed of the first wall element, the deflection element and the second and third wall elements being able to be arranged rotated about the longitudinal axis by an angle of 10° up to and including 180° with respect to the first installation body.

The second installation body can in particular have the same structure as the first installation body. The first installation body can be arranged rotated about an angle of 180° with respect to the second installation body.

All the installation bodies of the mixing element can in particular be connected by means of a bar element. The bar element can be arranged at the outer periphery of the deflection element. A bar element can be provided at each side of the wall element, but a plurality of bar elements can also be provided; in particular two respective bar elements can be provided at each side of the wall element.

The wall element can include an angle from 90 to 130° with the deflection surface.

The deflection surface can have a surface curved at least partly in the direction of the flowing fluid for deflecting the fluid flow in a direction differing from the longitudinal axis; a progressive curvature in the flow direction and the direction of the mixer housing can in particular be provided.

In accordance with an alternative embodiment, the deflection surface can be substantially planar. The deflection surface can in particular substantially extend at an angle of 90° to the wall element.

The deflection surface of the first installation body is in particular designed so that it covers the openings of the second installation body in the direction of the longitudinal axis.

In accordance with a further embodiment, the surface of the deflection element at the side which faces the first side wall of the wall element can lie at least partly in a transverse plane which is aligned at an angle of 60° to 90° to the longitudinal axis. Furthermore, the surface of the deflection element at the side which faces the second side wall of the wall element can lie in a transverse plane which is aligned at an angle of 60° to 90° to the longitudinal axis.

A reinforcement element can be provided between the second and third wall elements of the first installation body and the first wall element of the second installation body at their connection point. The transition between the first and second installation bodies can be improved in its shape stability and stiffness by this reinforcement element. The flow cross-section for the polymer melt is also increased at a connection point with a reinforcement element. The reinforcement element can be formed, for example, as a thickened portion or as a rib.

The static mixing element can in particular contain a foamed polymer. With respect to the conventional injection molding process, a polymer containing a foaming agent is used for the manufacture of the static mixer which foams during or directly subsequent to the injection. The injection molding method in particular includes the step of the injection of a polymer containing a foaming agent into an injection molding tool at an inner tool pressure of less than 600 bar, particularly preferably less than 500 bar.

A static mixer contains a mixing element in accordance with one of the preceding embodiments and a mixer housing which surrounds the mixing element.

The installation body has a length dimension and a diameter. For non-circular tubular mixer housings, the diameter corresponds to the edge length when the cross-sectional area of the tubular mixer housing is quadratic. For other shapes of the mixer housings, for example with rectangular or oval cross-sections, an equivalent diameter $D_a$ is determined under the assumption that the cross-sectional area were circular, that is using the formula $D_a=2*(A/\pi)^{1/2}$. $D_a$ then stands for the equivalent diameter, A, for the actual cross-sectional area. The ratio of longitudinal dimension to diameter is at least 1, with either the diameter of the circular cross-section or the equivalent diameter for non-circular cross-sections having to be used as the diameter.

The length dimension is the extent of the installation body in the direction of the longitudinal axis. The ratio of the length dimension to the diameter can in particular be greater than 1.

A plurality of installation bodies can in particular be arranged behind one another along the longitudinal axis. These installation bodies can either have the same construction or installation bodies of different construction can be combined with one another so that a mixer arrangement arises such as is shown in EP1312409 B1. The adjacent installation bodies are connected to one another at least via the bar elements so that the mixing element which is made up of this plurality of installation bodies is designed as a monolithic part. This means that the mixing element is manufactured in its totality in a single injection molding tool The installation body or the totality of the installation bodies can have a longitudinal dimension between 5 and 500 mm, preferably between 5 and 300 mm, preferentially between 50 and 100 mm.

The static mixer contains a mixing element in accordance with one of the preceding embodiments and a mixer housing which surrounds the mixing element. The mixing element has a longitudinal axis which coincides with the longitudinal axis of the mixer housing in the assembled state. Each of the installation bodies therefore also has this longitudinal axis. The longitudinal axis is aligned in the direction of a fluid flowing into the static mixer. The fluid includes at least two components which are supplied via an inlet element arranged upstream of the mixing element.

The flow of the product to be mixed is deflected in the interior of the mixing space by means of the deflection element so that the components which enter into the tubular mixer housing with an installed mixing element as strands are divided continuously during their path through the static mixer into strips of reducing width, whereby components which are difficult to mix or have high viscosity can also be processed with this static mixer.

The fluid to be mixed as a rule includes two different components. In most cases, the components are present in the liquid state or as viscous materials. These include, for example, pastes, adhesives, but also fluids which are used in the medical sector which include pharmaceutical agents or fluids for cosmetic applications and foods. Such static mixers are also in particular used as disposable mixers for the mixing of a hardening mixing product of flowable components such as the mixing of multicomponent adhesives. Another preferred use is in the mixture of impression materials in the dental field.

The static mixers described above are suitable as disposable mixers since their manufacturing and material costs are low as soon as the corresponding injection molding tool has been manufactured. Furthermore, the static mixers are used in metering and/or mixing units. The static mixer can be attached to a dispensing unit or to a dispensing cartridge, in particular to a multicomponent cartridge. In particular a multicomponent cartridge can be named as an example which includes a dispensing apparatus and a tube which is coupled to the dispensing apparatus and which contains a static mixer in accordance with one of the preceding embodiments.

Additional features and advantages are described herein, and will be apparent from the following Detailed Description and the figures.

DETAILED DESCRIPTION

Figure 1:
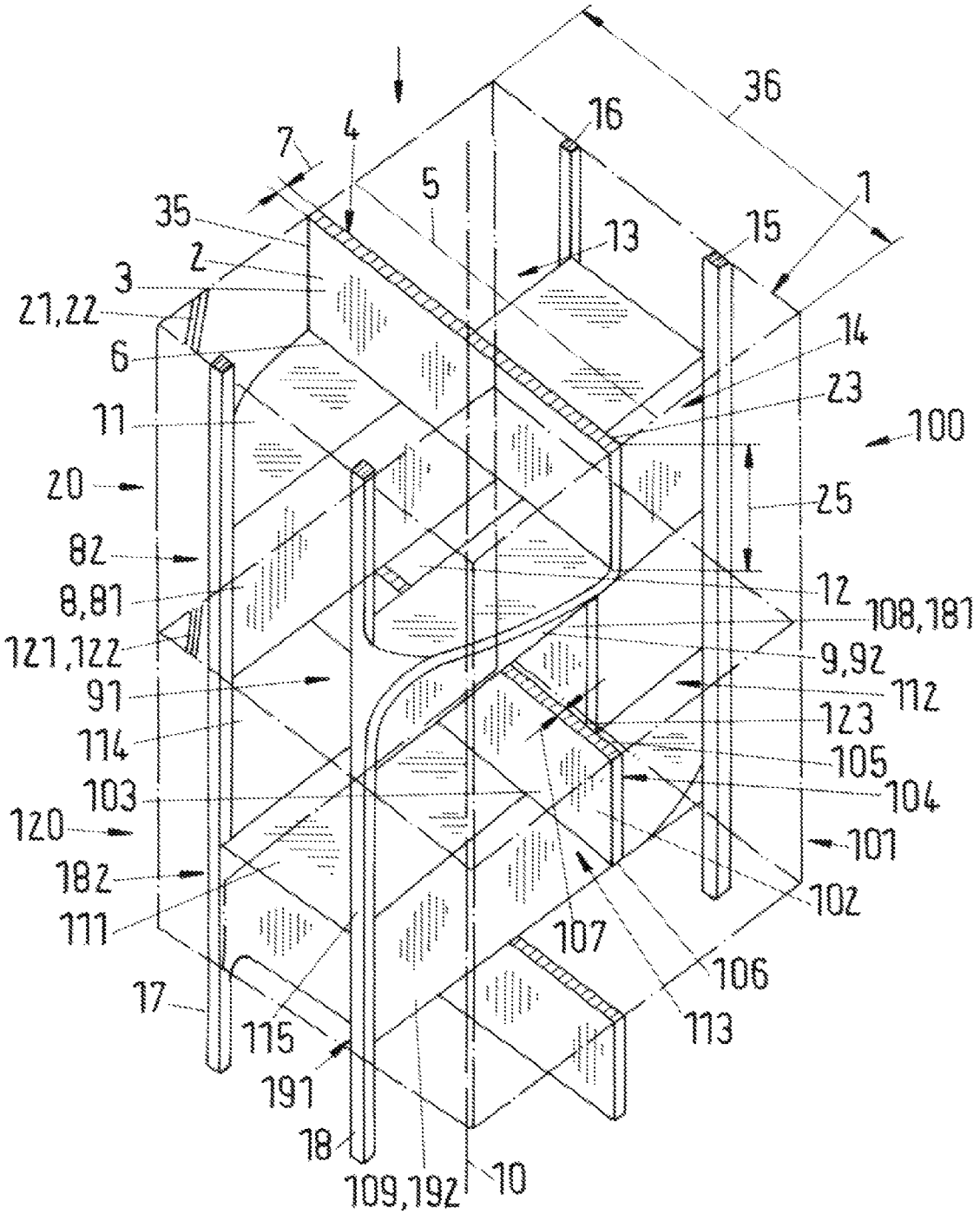
FIG. 1 is an embodiment of a section of a mixing element in accordance with the first embodiment of the invention.

An embodiment of a mixing element 100 for a static mixer in accordance with a first embodiment of the invention is shown in FIG. 1. The mixing element includes an installation body 1 which is installed in a tubular housing which is not shown. The tubular housing serves as a boundary of a mixing space 20 which is located in the interior of the tubular housing. A fluid to be mixed, which is as a rule made up of at least two different components, flows through the mixing space 20. In most cases, the components are present in the liquid state or as viscous materials. These include, for example, pastes, adhesives, but also fluids which are used in the medical sector which include pharmaceutical agents or fluids for cosmetic applications and foods. Such static mixers are also in particular used as disposable mixers for the mixing of a hardening mix of flowable components such as the mixing of multicomponent adhesives. Another preferred use is in the mixture of impression materials in the dental field.

The mixing element in accordance with FIG. 1 thus includes an installation body 1 for installation into a tubular mixer housing, with the installation body 1, 101 having a longitudinal axis 10 which is aligned in the direction of a fluid flowing into the installation body 1. A mixing space 20 which is bounded at the peripheral side by a mixer housing, not shown, can be spanned by the installation body 1. A cubic mixing space is indicated in FIG. 1 to facilitate understanding. The side surfaces of the cube can represent the inner walls of the mixer housing. The fluid flows from the cover surface of the cube, which forms a flow cross-sectional surface 22, in the direction of the installation body 101.

The installation body 1 and the installation body 101 have the same structure; however, the installation body 101 is rotated by 180° about the longitudinal axis 10. Like the mixing space 20, the mixing space 120 has a flow cross-sectional surface 122 in a plane 121 arranged normal to the longitudinal axis 10 which essentially corresponds to the flow cross-sectional surface of the tubular mixer housing surrounding the installation body 101. For installation bodies 1, 101 which have at least one plane of symmetry which divides the mixing space into two equal parts, the longitudinal axis is disposed in this plane of symmetry. The mixing space is bounded by the mixer housing, not shown. In this embodiment, the mixing element should be installed into a mixer housing having a rectangular or quadratic cross-section. The inner dimension of the mixer housing which is used for determining the equivalent diameter is given by reference line 36.

The installation body 1 contains at least one first wall element 2 which serves a division of the fluid flow into two part flows flowing substantially parallel to the longitudinal axis 10. The wall element 2 has a first side wall 3 and a second side wall 4. The intersection of the first wall element 2 with the plane 21 produces a cross-sectional surface 23. This cross-sectional surface 23 amounts to a maximum of ⅕, preferably a maximum of 1/10, particularly preferably a maximum of 1/20, of the flow cross-sectional surface 22 of the mixing space 20 without installation bodies. The fluid thus flows at both sides of the side walls 3, 4 of the wall element 2. The flow direction of the fluid is indicated by an arrow. The wall element has a substantially rectangular cross-section. The first wall element 2 has a first wide side 5, a second wide side 6 as well as a first and second long side 25, 35. The first wide side 5, the second wide side 6, the first long side 25 and the second long side 35 form the periphery of each of the side walls 3, 4. The long sides 25, 36 extend substantially in the direction of the longitudinal axis 10 and the first wide side 5 and the second wide side 6 extend transversely to the direction of the longitudinal axis. The first wall element 2 divides the mixing space into two parts. The wall element 2 has the function of a bar element which divides the fluid flow into two parts, with their deflection being negligible with the exception of the deflection at the edges of the first wide side 5. The wall thickness 7 of the wall element 2 usually amounts to less than 1 mm for a mixing element with a total length of up to 100 mm.

A deflection element 11 which serves for the deflection of the part flows in a direction differing from the longitudinal axis adjoins the first wall element 2. The deflection element has a deflection surface extending in the transverse direction to the wall element 2 at both sides of the wall element. A first opening 12 is provided in the deflection surface at the side which faces the first side wall 3 of the wall element 2.

The crossing angle between the first wall element 2 and the second or third wall element 8, 9 respectively amounts to 90° in the embodiment in accordance with FIG. 1. In accordance with FIG. 1, the first wall element 2 is connected to the second wall element 8 and to the third wall element 9 via the deflection element 11. The deflection element 11 is preferably disposed in a plane which is aligned parallel to the plane 21 or is arranged at an angle of inclination with respect to the plane, with the angle of inclination amounting to no more than 60°, preferably no more than 45°, particularly preferably no more than 30°. The smaller the angle of inclination between the surface of the deflection element 11 and the plane 21, the smaller the required construction length. Or in other words: the surface of the deflection element 11 is substantially disposed in a transverse plane which is aligned at an angle of 45° up to 90°, preferably of 60° up to 90°, particularly preferably of 75° up to 90° to the longitudinal axis 10.

The wall elements 8, 9 adjoining the deflection element 11 bound a passage which starts from the first opening 12 and extends in the direction of the longitudinal axis 10. It is meant by the expression "adjoining the deflection element" that the second and third wall elements 8, 9 are arranged opposite the first wall element 2 in the direction of the longitudinal axis, that is arranged downstream of the first wall element 2 in the direction of flow.

A second opening is provided in the deflection surface at the side which faces the second side wall 4 of the wall element 2, with the second or third wall elements 8, 9 adjoining the second opening. The second and third wall elements 8, 9 bound the same passage which also starts from the first opening 12.

A second and a third wall element 8, 9 are thus arranged adjacent to the first opening 12. The second and third wall elements 8, 9 extend in the direction of the longitudinal axis 10 and each have an inner wall 81, 91 and an outer wall 82, 92 which extend substantially in the direction of the longitudinal axis 10. The second wall element 9 has the inner wall 81 and the outer wall 82. The third wall element has the inner wall 91 and the outer wall 92. In the present embodiment, the inner walls 81, 91 and the outer walls 82, 92 extend in the direction of the longitudinal axis, that is in the vertical direction in the direction of the drawing. Each of the inner walls 81, 91 and outer walls 82, 92 can include an angle between 20° and 160° to the first or second side walls 3, 4 of the first wall element 2. The first opening 12 is arranged between the inner walls 81, 91 of the second and third wall elements 8, 9. A second opening 13 and an optional third opening 14 are arranged outside one of the outer walls 82, 92 of the second or third wall elements 8, 9. The second opening 13 and the third opening 14 are provided in the deflection surface at the side which faces the second side wall 4 of the first wall element 2. The inner wall of each wall element can in particular be parallel to its outer wall. Furthermore, the second and third wall elements can have inner walls 81, 91 and outer walls 82, 92 respectively in parallel with one another.

The first wall element 102 of the second installation body 101 adjoins the second and third wall elements 8, 9. The second installation body 101 has a first wall element 102 which extends in the direction of the longitudinal axis 10 of the mixing element and has a first side wall 103 and a second side wall 104 which is arranged opposite the first side wall 103. The first side wall 103 and the second side wall 104 are arranged substantially parallel to the longitudinal axis 10.

A deflection element 111 is arranged adjacent to the first wall element 102. The deflection element 111 has a deflection surface extending in the transverse direction to the wall element 102 at both sides thereof. A first opening 112 is provided in the deflection surface at the side which faces the second side wall 104 of the wall element 102. A second and a third wall element 108, 109 are disposed opposite the first wall element 102 in the direction of the longitudinal axis 10 adjacent to the first opening 112. That is, the second and third wall elements 108, 109 are located downstream of the first wall element 102. The second and third wall elements 108, 109 bound a passage starting from the first opening 112 and extending in the direction of the longitudinal axis 10. A second opening 113, 114 is provided in the deflection surface at the side which faces the first side wall 103 of the wall element 102. The second or third wall elements 108, 109 adjoin the second opening 113, 114.

A second wall element 108 and a third wall element 109 are arranged adjacent to the first opening 112. The second and third wall elements 108, 109 extend in the direction of the longitudinal axis 10 of the mixing element. The second wall element has an inner wall 181 and an outer wall 182 and the third wall element has an inner wall 191 and an outer wall 192. The outer walls 182, 192 and the inner walls 181, 191 extend substantially in the direction of the longitudinal axis 10 of the mixing element. They are respectively parallel to one another in the present embodiment. Each of the inner walls 181, 191 and outer walls 182, 192 include an angle between 20° and 160° to the first or second side walls 103, 104 of the first wall element 102, 90° in the present case. The first opening 112 is arranged between the inner walls 181, 191 of the second and third wall elements 108, 109 and at least one second opening 113, 114 is arranged outside one of the outer walls 182, 192 of the second or third wall elements 108, 109. The second opening 113 and/or a third opening 114 are provided in the deflection surface at the side which faces the second side wall 104 of the first wall element 102.

The second installation body 101 containing the first wall element 102, the deflection element 111 and the second and third wall elements 108, 109 is arranged rotated about the longitudinal axis 10 by an angle of 10° up to and including 180°, in the specific example of 180°, with respect to the first installation body 1.

The first installation body 1 and the second installation body 101 have the same structure, that is they contain the same wall elements and the same deflection elements which are arranged at respectively the same angles and spacings from one another.

The first installation body 1 and the second installation body 101 are connected to one another via a plurality of common bar elements 15, 16, 17, 18.

Figure 2:
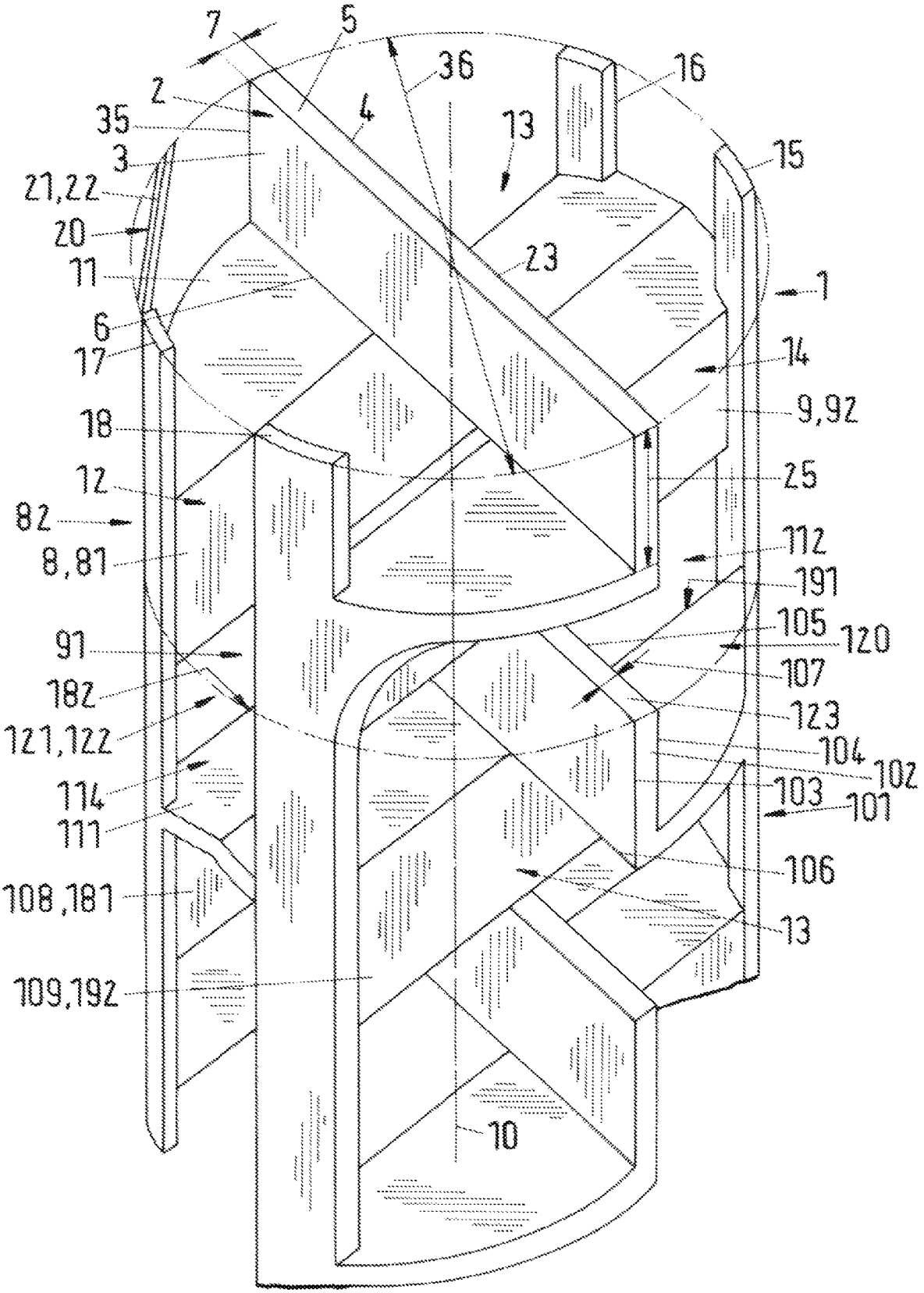
FIG. 2 is an embodiment of a section of a mixing element in accordance with a second embodiment of the invention.

FIG. 2 shows an embodiment of a section of a mixing element in accordance with a second embodiment of the invention. The structure of the mixing element does not substantially differ from the mixing element in accordance with FIG. 1; the same reference numerals as in FIG. 1 are therefore used for the same parts. Only the differences from the embodiment in accordance with FIG. 1 should also be looked at in the following. A first installation body 1 and a second installation body 101 are shown in turn of the mixing element. The installation bodies are intended for installation into a mixer housing which has a circular or elliptical cross-section. The cross-sectional extent of the inner wall of the mixer housing, not shown, is indicated by a chain-dotted line. The diameter of the mixer housing is shown by a reference line 36.

Figure 3:
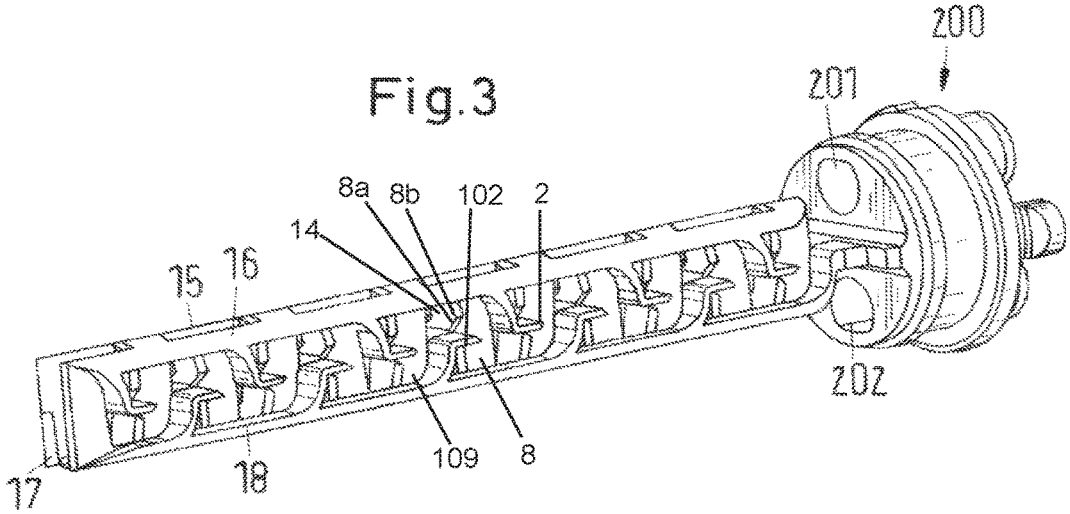
FIG. 3 is a view of a mixing element with installation bodies in accordance with FIG. 2.

FIG. 3 shows a view of a first embodiment of a mixing element in accordance with the invention. The mixing element contains installation bodies, as shown in FIG. 2. Furthermore, the mixing element contains an inlet element which contains the feed passages for the components to be mixed. The mixing ratio of the two components can be equal to 1:1, but also be different, that is not equal to 1:1. 11 installation bodies are shown in FIG. 3. All installation bodies are connected to one another by bar elements 15, 16, 17, 18.

Figure 4:
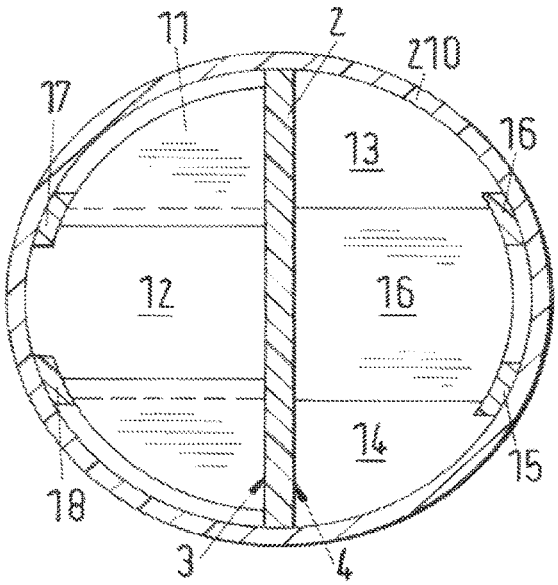
FIG. 4 is a section through an installation body in accordance with FIG. 2.

FIG. 4 shows a section through the installation body 1 of FIG. 2. The first wall element 2 and the bar elements 15, 16, 17, 18 are sectioned. The deflection element 11 is visible in the section in accordance with FIG. 4. The deflection element 11 contains the first opening 12 which is arranged at the left side of the first wall element 2 in FIG. 4, that is on the side of its first side wall 3. The second opening 13 and the third opening 14 are arranged on the opposite side, that is on the second side wall 4. The first opening 12 is arranged offset with respect to the second and third openings 13, 14. A part element 26 of the deflection element is arranged between the second and third openings. The fluid which impacts onto the part element 26 is deflected in the direction of the second opening 13 and of the third opening 14. At the peripheral side, the second opening 13 and the third opening 14 are bounded by the mixer housing 210.

Figure 5:
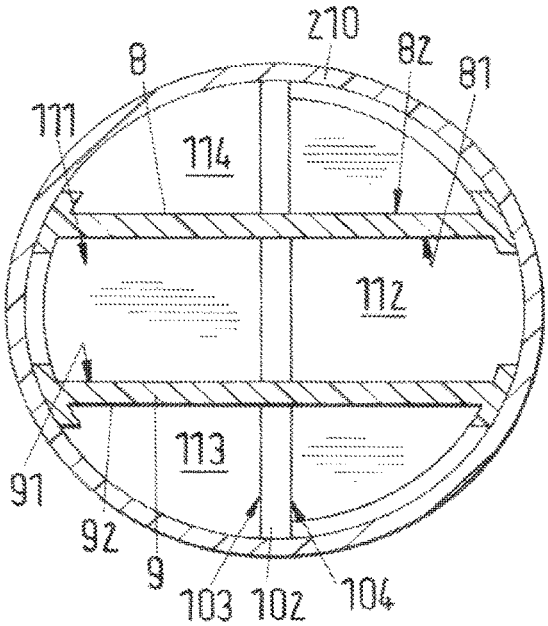
FIG. 5 is a section through the installation body which is arranged adjacent to the installation body in accordance with FIG. 4.

FIG. 5 shows a section through the second and third wall elements 8, 9 of the installation body 1. The direction of gaze is in the flow direction so that the first wall element 102 of the installation body 101 is visible. The deflection element 111 adjoins the first wall element 102 of the installation body 101. The deflection element 111 contains a first opening 112 which is arranged on the side of the second side wall 104. A second opening 113 and a third opening 114 are arranged on the side of the first side wall 103. The second opening 113 and the third opening 114 are arranged offset to the first opening 112. The first, second and third openings 112, 113, 114 are arranged such that a part element is respectively arranged opposite each of the openings, that is a first part element 126 opposite the first opening 112, a second part element 127 opposite the second opening 113 and a third part element 128 opposite the third opening.

Figure 6:
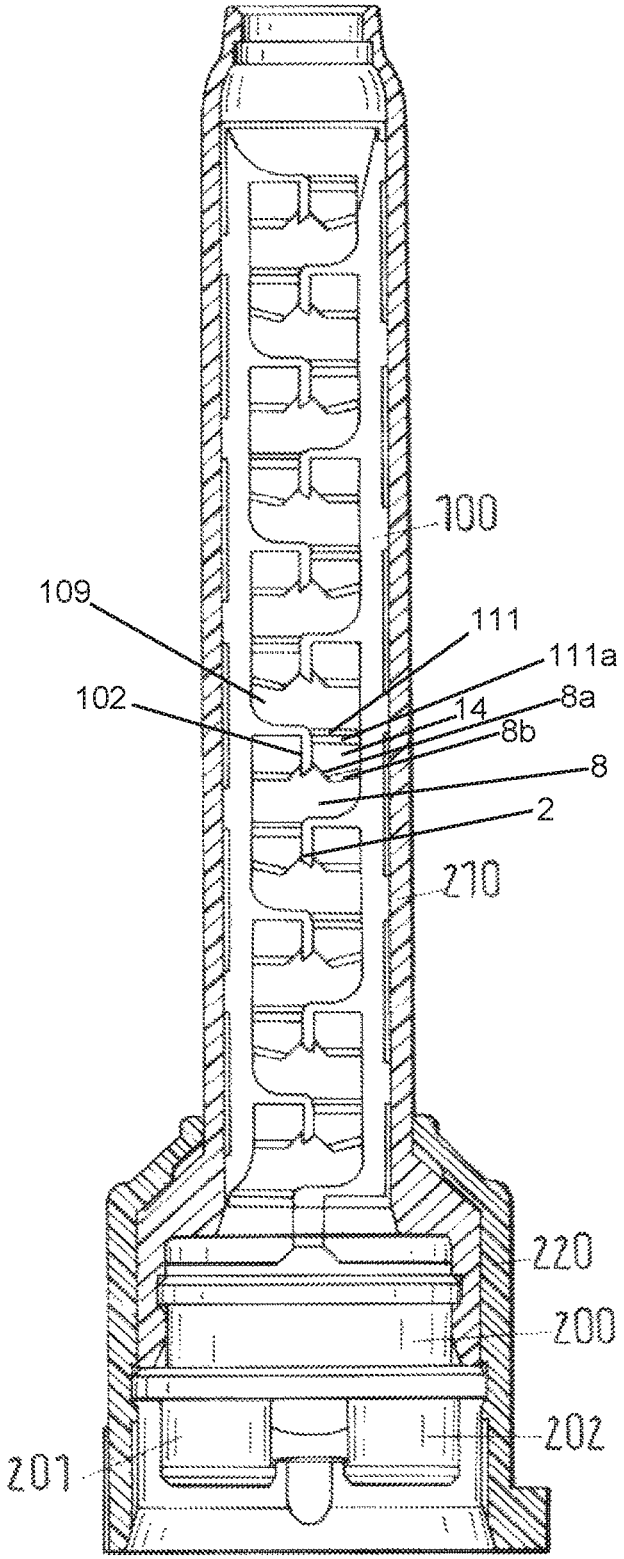
FIG. 6 is a section through an inlet part of a static mixer and mixing element in accordance with FIG. 3.

FIG. 6 shows a section through an inlet part of a static mixer and a mixing element in accordance with FIG. 3. The static mixer includes a mixer housing 210 in which the mixing element and the inlet element are received. The mixer housing is received in a connection element 220 which serves for connection to a cartridge.

As shown in FIGS. 2, 3 and 6, the first wall element 102 of the installation body 101, the deflection surface 111*a* of the deflection element 111 at the side which faces the second side wall 104 of the first wall element 102, the common bar elements (e.g. 15, 16, 17 and 18) and the second and third wall elements 8, 9 of the second installation body 1 define a transverse passage 14 of non-rectangular (e.g. pentagonal) cross-section. Further, as specifically illustrated in FIG. 6, the surfaces of the second and third wall elements 8,9 of the installation body 1 opposite from the deflection surface 111*a* at the side facing the second side wall 104 of the first wall element 102 of the installation body 101 each comprise an inner surface portion (e.g. 8*a*) and an outer surface portion (e.g. 8*b*), and the inner surface portion 8*a* has a smaller length than the outer surface portion 8*b*. The inner surface portion 8*a* and an outer surface portion 8*b* along with the other structure defining the transverse passage 14 form a pentagonal cross-section for the transverse passage 14.

For this reason, in accordance with the invention, the bar elements for forwarding the polymer melt in the manufacturing process are provided from one installation body to each of the adjacent installation bodies.

The static mixer is usually produced from plastic by means of which even comparatively complicated geometries can be realized in the injection molding process. The totality of installation bodies 1, 101 has a length dimension 24 and each of the cross-sectional areas 23, 123 have a wall thickness 7 in particular for static mixers including a plurality of installation bodies. The ratio of length dimension 24 to wall thickness 7 amounts to at least 40, preferably at least 50, particularly preferably at least 75. For the preferred use of static mixers for small fluid quantities of filler material, the wall thickness 7 is less than 3 mm, preferably less than 2 mm, particularly preferably less than 1.5 mm. The totality of the installation bodies 1, 101 has a longitudinal dimension 24 between 5 and 500 mm, preferably between 5 and 300 mm, preferably between 50 and 100 mm.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A mixing element for a static mixer for installation into a tubular mixer housing, comprising:

a plurality of first and second installation bodies arranged behind one another along a longitudinal axis of the mixing element, each of the first and second installation bodies having a first wall element extending in a direction of the longitudinal axis and a first side wall and a second side wall arranged opposite the first side wall;

a deflection element arranged adjacent to each of the first wall elements, each of the deflection elements having a deflection surface extending in a transverse direction to the first wall element at both sides of a respective first wall element, a first opening is disposed in each of the deflection surfaces at a side facing the first side wall of the respective first wall element, second and third wall elements arranged adjacent to each of the first openings, the second and third wall elements extending in the direction of the longitudinal axis and each having an inner wall and an outer wall extending substantially in the direction of the longitudinal axis and each of the inner walls and outer walls including an angle between 20° and 160° to the first or second side walls of the respective first wall element, each of the first openings is arranged between the inner walls of a respective second and third wall elements and a second opening arranged outside one of the outer walls of the respective second or third wall elements, the second opening is disposed in a respective deflection surface at a side facing the second side wall of the respective first wall element, the first wall element of the second installation body adjoining the second and third wall elements of the first installation body, the second installation body arranged rotated about the longitudinal axis by an angle of 180° with respect to the first installation body, the first and second installation bodies connected to one another by a common bar element, and the first wall element of the second installation body, the deflection surface of the deflection element of the second installation body at the side facing the second side wall of the first wall element of the second installation body, the common bar element and each of the second and third wall elements of the first installation body define a transverse passage of non-rectangular cross-section.

2. The mixing element in accordance with claim 1, wherein all installation bodies of the mixing element are connected by the common bar element.

3. The mixing element in accordance with claim 1, wherein the common bar element is arranged at the outer periphery of the deflection element.

4. The mixing element in accordance with claim 1, wherein a common bar element is disposed at each side of the first wall element.

5. The mixing element in accordance with claim 1, wherein the common bar element is one of two respective common bar elements disposed at each side of the wall element.

6. The mixing element in accordance with claim 1, wherein the first wall element of each of the first and second installation bodies includes an angle of 90° to 130° with the respective deflection surface.

7. The mixing element in accordance with claim 1, wherein each of the deflection surfaces has a surface curved at least partly in the direction of flowing fluid for deflecting the fluid flow in a direction differing from the longitudinal axis.

8. The mixing element in accordance with claim 1, wherein each of the deflection surfaces is substantially planar.

9. The mixing element in accordance with claim 1, wherein each of the deflection surfaces extends substantially at an angle of 90° to the first wall element.

10. The mixing element in accordance with claim 1, wherein the deflection surface of the first installation body is designed to cover the openings of the second installation body in the direction of the longitudinal axis.

11. The mixing element in accordance with claim 1, wherein the surface of each of the deflection elements at the side facing the first side wall of the respective first wall element lies in a transverse plane aligned at an angle of 60° to 90° to the longitudinal axis.

12. The mixing element in accordance with claim 1, wherein the surface of the deflection element at the side facing the second side wall of the respective first wall first wall element lies in a transverse plane aligned at an angle of 60° to 90° to the longitudinal axis.

13. A mixing device, comprising:

the static mixer containing a mixing element in accordance with claim 1; and a mixer housing surrounding the mixing element.

14. The mixing element in accordance with claim 1, wherein the surfaces of the second and third wall elements of the second installation body opposite from the deflection surface at the side facing the second side wall of the first wall element of the first installation body each comprise an inner surface portion and an outer surface portion, and the inner and outer surface portions have different lengths.

15. The mixing element in accordance with claim 1, wherein the surfaces of the second and third wall elements of the second installation body opposite from the deflection surface at the side facing the second side wall of the first wall element of the first installation body each comprise an inner surface portion and an outer surface portion, and the inner surface portion has a smaller length than the outer surface portion.

16. The mixing element in accordance with claim 1, wherein the passage has a pentagonal cross-section.

* * * * *